US008707833B1

(12) United States Patent
Gedeon

(10) Patent No.: US 8,707,833 B1
(45) Date of Patent: Apr. 29, 2014

(54) PLIERS WITH OFFSET HANDLES

(76) Inventor: Walter J. Gedeon, Vacaville, CA (US)

( * ) Notice: Subject to any disclaimer, the term of this patent is extended or adjusted under 35 U.S.C. 154(b) by 509 days.

(21) Appl. No.: 13/078,201

(22) Filed: Apr. 1, 2011

(51) Int. Cl.
*B25B 7/10* (2006.01)
*B25B 5/16* (2006.01)

(52) U.S. Cl.
USPC ..... 81/414; 81/420

(58) Field of Classification Search
USPC ..... 81/414, 415, 420–423, 9.4, 489
See application file for complete search history.

(56) References Cited

U.S. PATENT DOCUMENTS

| | | | | |
|---|---|---|---|---|
| 1,216,886 | A * | 2/1917 | Thomson | 81/420 |
| 1,600,747 | A * | 9/1926 | Yurkovitch | 188/65.1 |
| 2,630,729 | A * | 3/1953 | Arner | 81/13 |
| 2,882,775 | A * | 4/1959 | Rank et al. | 81/414 |
| 3,186,265 | A | 6/1965 | Wenturine et al. | |
| 3,383,962 | A | 5/1968 | Harris | |
| 4,748,875 | A | 6/1988 | Lang | |
| 4,905,550 | A * | 3/1990 | Albrecht | 81/185.1 |
| 5,271,300 | A | 12/1993 | Zurbuchen et al. | |
| 5,893,303 | A * | 4/1999 | Harris | 81/44 |
| 6,098,503 | A | 8/2000 | Hlinka | |
| 6,339,980 | B1 * | 1/2002 | Woolf | 81/185.1 |
| 6,345,558 | B1 * | 2/2002 | Wilson | 81/420 |
| 6,513,198 | B2 * | 2/2003 | Lu | 16/431 |
| 7,156,004 | B1 * | 1/2007 | Whitehead et al. | 81/420 |
| 8,074,536 | B1 * | 12/2011 | Allen | 81/9.4 |
| 2004/0089117 | A1 | 5/2004 | Hsien | |
| 2012/0180607 | A1 * | 7/2012 | Chen | 81/423 |

* cited by examiner

*Primary Examiner* — David B Thomas
(74) *Attorney, Agent, or Firm* — Robert C. Montgomery; Montgomery Patent & Design

(57) ABSTRACT

A set of pliers having either right or left offset handles, each of which provides clearance for a user's hand when used for gripping an object protruding from a large flat surface. The pliers include adjustable slip-joint tongue-and-groove plier jaws with offset angled handles. The handles are intermediately angled to a right side or left side to allow gripping or rotating of an object located in close proximity to a flat wall or floor surface, while maintaining a parallel relationship between the pliers and the adjacent surface. The pliers also include jaw covers to protect fine surfaces, and contrasting colored handle grips.

19 Claims, 4 Drawing Sheets

PLIERS WITH OFFSET HANDLES

RELATED APPLICATIONS

The present invention was first described in a notarized Official Record of Invention on Jun. 21, 2010, that is on file at the offices of Montgomery Patent and Design, LLC, the entire disclosures of which are incorporated herein by reference.

FIELD OF THE INVENTION

The present invention relates generally to pliers, and in particular, to pliers having offset handles for use against large flat objects.

BACKGROUND OF THE INVENTION

A common tool found in many toolboxes is that of tongue-and-groove pliers, commonly known as CHANNEL-LOCK®. These pliers, with their adjustable size capability are capable of turning and holding nuts and bolts, gripping round and irregularly shaped objects, clamping materials, holding materials, and a myriad of other functions. Their serrated jaws can be moved to a number of positions by sliding along a track section allowing the pliers to adjust to a number of sizes. However, as useful as such pliers are, they cannot be used up against a large flat object, such as on a pipe going through a wall. This is because there is inadequate space to get one's hands and fingers around the handles when the handles are flat against the surface.

SUMMARY OF THE INVENTION

The inventor has therefore recognized the aforementioned inherent problems and lack in the art and observed that there is a need for a device in which the customizable gripping features of tongue and groove pliers can be used against large flat objects without the disadvantages as described above. In accordance with the invention, it is an object of the present disclosure to solve these problems.

The inventor recognized these problems and has addressed this need by developing pliers with offset handles that provides a set of adjustable jaw pliers that can safely and easily be used closely against large, flat objects in a manner which is quick, easy, and effective. The inventor has thus realized the advantages and benefits of providing pliers with offset handles having a first plier member having a toothed jaw, a joining portion, and an offset handle and a second plier member adjustably fastened to the first plier member also having a toothed jaw, a joining portion, and an offset handle. Each of the offset handles includes a jaw portion which terminates in the toothed jaw, a grip portion opposite the toothed jaw, and an offset portion extending between the jaw portion to the grip portion at an angle forming an offset stand-off between the grip portion relative to the jaw portion. The second plier member toothed jaw is position adjustable relative to the first plier member toothed jaw. The offset portion forms an angle of approximately twenty degrees to approximately forty five degrees (45°). The offset portions position the grip portions to the right of jaw portions or to the left of the jaw portions depending upon the model used.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
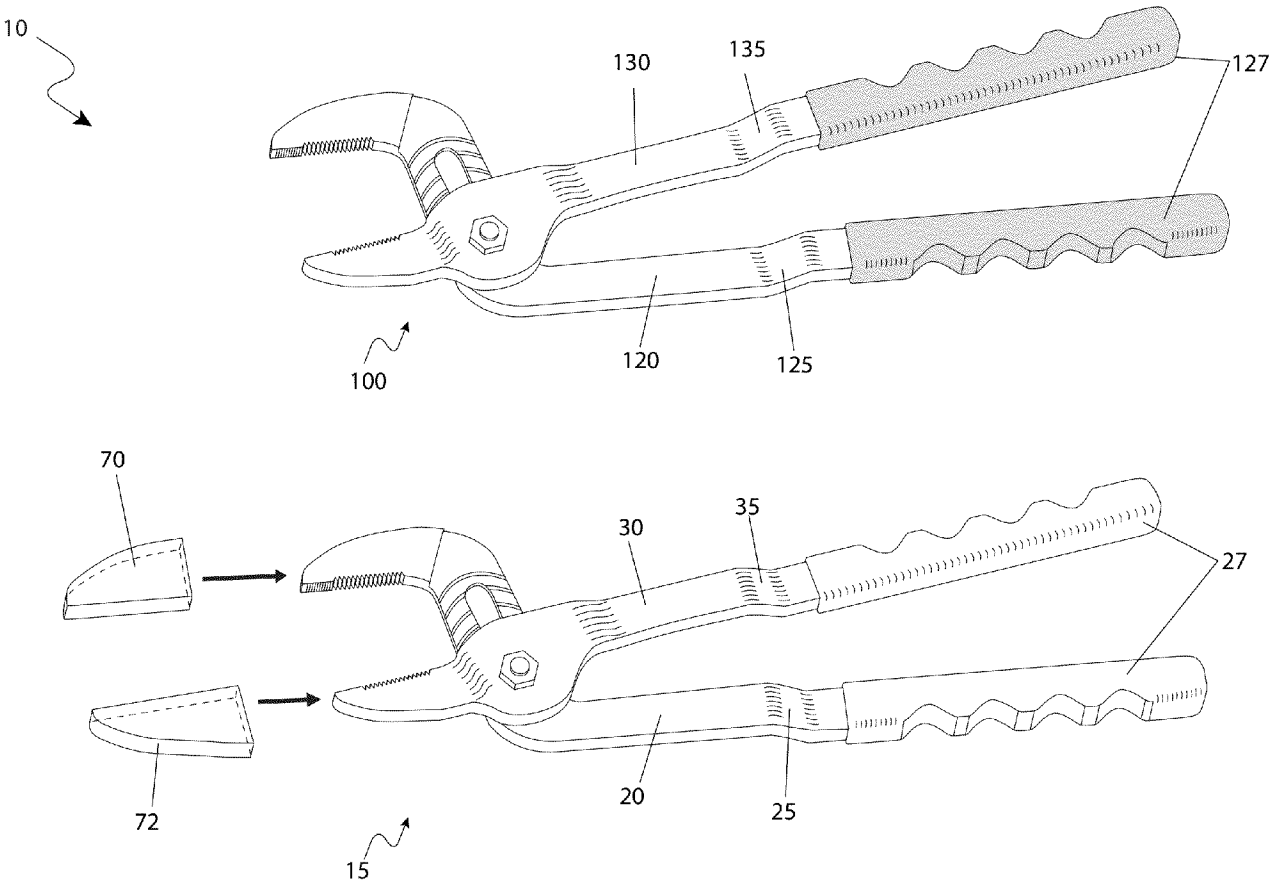
FIG. 1 is a perspective view of pliers with offset handles, according to a preferred embodiment in accordance with the invention.

10 pliers with offset handles
15 right offset embodiment
20 first right offset handle
22 first gripping toothed jaw
24 tongue and groove portion
25 first right offset feature
27 right-offset handle grip
30 second right offset handle
32 second gripping toothed jaw
35 second right offset feature
39 finger relief
50 bolt fastener
52 nut fastener
55 dimension 'A'
70 first jaw cover
72 second jaw cover
90 gripped object
95 working surface
100 left offset embodiment
120 first left-offset handle
125 first left-offset feature
127 left-offset handle grip
130 second left-offset handle
135 second left offset feature

DETAILED DESCRIPTION OF THE PREFERRED EMBODIMENT

In accordance with the invention, the best mode is presented in terms of a preferred embodiment, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 4, depicting pliers with offset handles (herein described as a "device") 10, where like reference numerals represent similar or like parts. In accordance with the invention, the present disclosure describes an enhanced pair of slip-joint pliers being similar to CHANNELLOCK® brand pliers. The device 10 includes a right offset embodiment 15 and a left offset embodiment 100 having respective right offset handles and left offset handles. The plier handles of each embodiment include respective intermediately located offset features including a stand-off section of each handle which offsets a gripped portion of the handles in a right or left sideward direction relative a jaw portion of the pliers.

FIG. 1 shows a perspective view of the right offset embodiment 15 and the left offset embodiment 100 of the device 10. The device 10 is preferably provided in a set of two (2) including both embodiments 15, 100 having handle portions arranged in a "mirror-image" manner to each other. It can be appreciated that the device 10 can also be introduced as a singular right offset embodiment 15 or a singular left offset embodiment 100, and as such should not be interpreted as a limiting factor.

Figure 2:
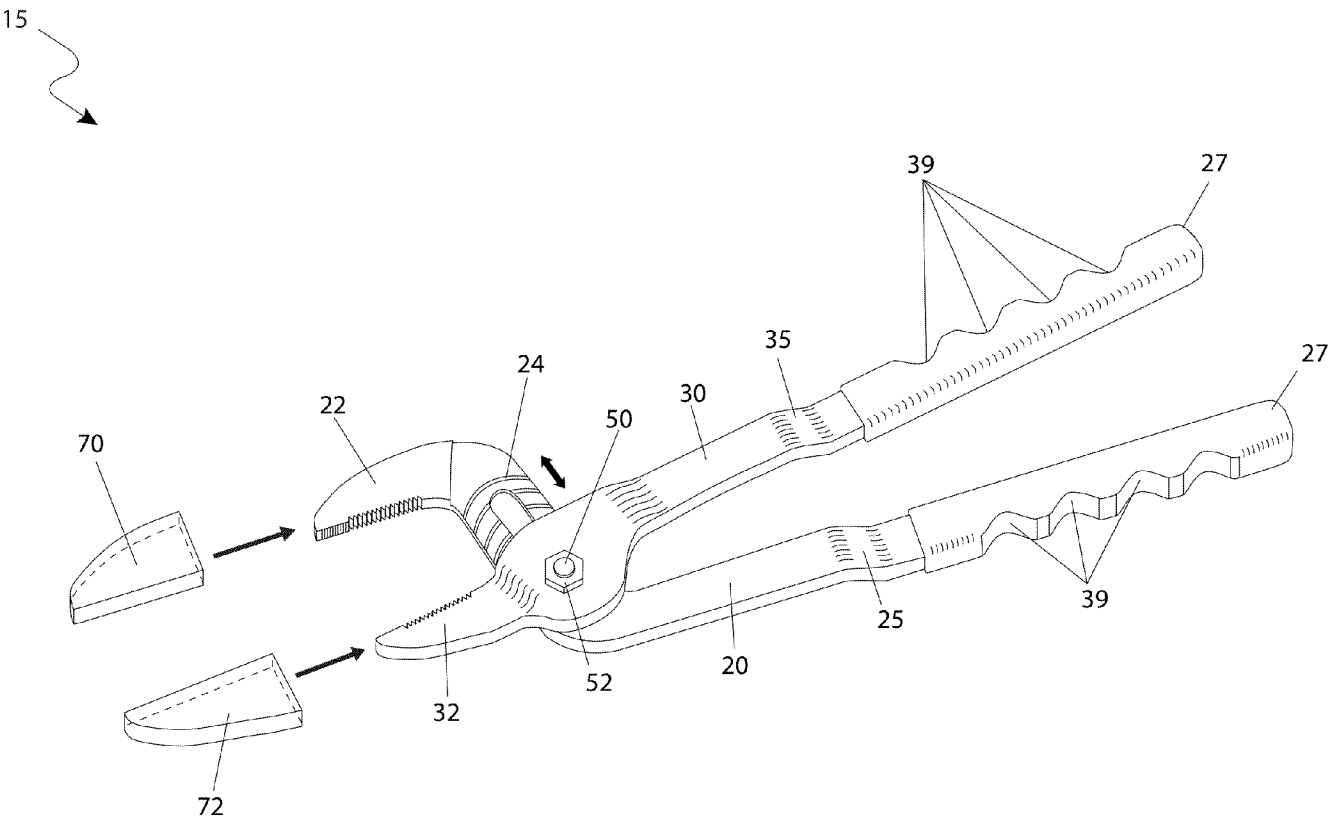
FIG. 2 is a perspective view of a right offset embodiment of the pliers with offset handles, according to the preferred embodiment.
Figure 3:
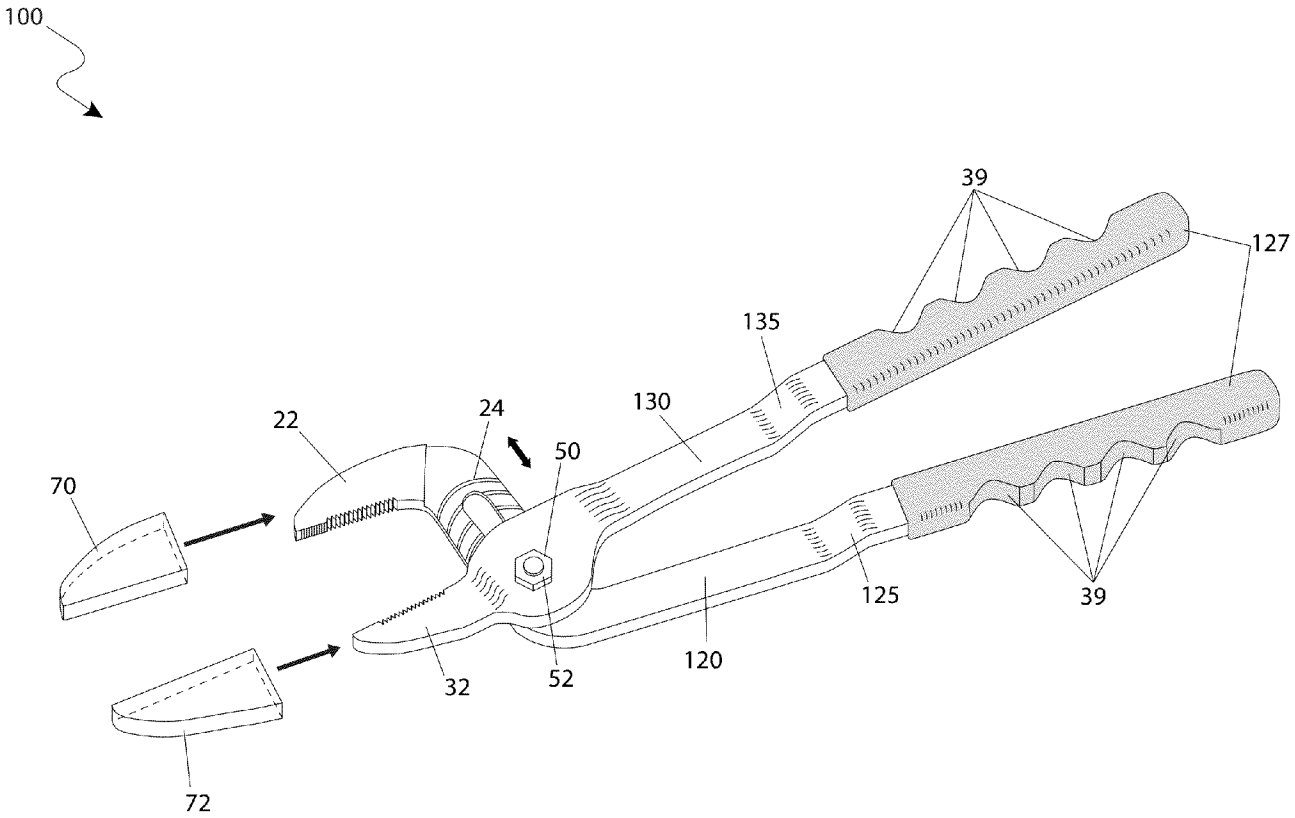
FIG. 3 is a perspective view of a left offset embodiment of the pliers with offset handles, according to the preferred embodiment; and, FIG. 4 is a bottom view of the right handed embodiment of the pliers with offset handles depicted in an in-use state, according to the preferred embodiment.

FIG. 2 shows a perspective view of the right offset embodiment 15 and FIG. 3 shows a perspective view of the left offset embodiment 100. The right offset embodiment 15 includes expected features similar to adjustable slip-joint pliers found on the market including, but not limited to: a first gripping toothed jaw 22, a second gripping toothed jaw 32, a selectable jaw adjusting tongue-and-groove portion 24, a peened bolt fastener 50, and a nut fastener 52 to pivotably join the handle portions. The right offset embodiment 15 also includes a first right offset handle 20 affixed to and in mechanical communication with the first gripping toothed jaw 22 and a second right offset handle 30 affixed to and in mechanical communication with the second gripping toothed jaw 32. The first right offset handle 20 includes a first right offset feature 25 which positions the gripped end of the first right offset handle 20 at a stand-off position parallel to the first gripping toothed jaw 22. The second right offset handle 30 includes a second right offset feature 35 which positions the gripped end of the second right offset handle 30 at a stand-off position parallel to the second gripping toothed jaw 32.

The left offset embodiment 100 includes similar materials and function as the previously described right offset embodiment 15; however, a first left offset feature 125 and second left offset feature 135 of a first left offset handle 120 and second left offset handle 130 are to be formed as a mirror-image compared to the respective right offset features 25, 35 of the right offset embodiment 15. The left offset features 125, 135 position the gripped end of the left offset handles 120, 130 at a stand-off position parallel to the first gripping toothed jaw 22 and the second gripping toothed jaw 32, respectively.

The right offset embodiment 15 and the left offset embodiment 100 further include respective color-coded plastic or rubber right offset handle grips 27 and left offset handle grips 127, respectively. The respective handle grips 27, 127 provide contrasting colored pigmentations for visual identification of the particular embodiment as well as provide a high-friction handle surface for firm gripping of the device 10 during use. The handle grips 27, 127 preferably include materials and methods common in the industry such as, but not limited to: urethane, natural rubber, plastic, or the like and are preferably hollow form-fitting sleeved enclosures that are coupled over the handles 20, 30, 120, 130 using adhesives. The handle grips 27, 127 also include outward-facing indented finger relief features 39 to further enhance gripping.

The first 22 and second 32 gripping jaws provide protection to fine finishes such as chrome from teeth portions of the jaws 22, 32 by application of a respective first jaw cover 70 and a second jaw cover 72. The jaw covers 70, 72 are hollow form-fitting members which fit snuggly over the gripping jaws 22, 32 and are removably attachable and made of a protective rubber or plastic material.

Figure 4:
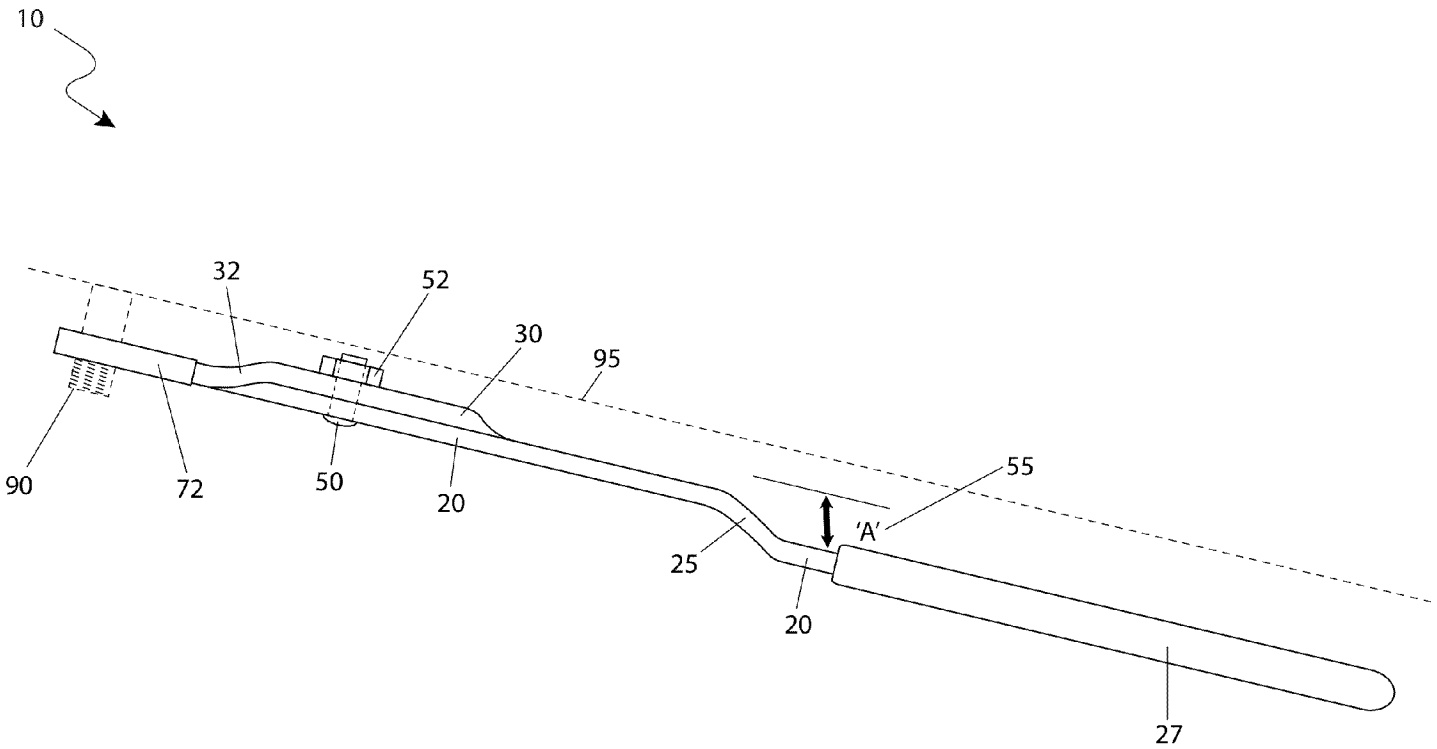

FIG. 4 shows a bottom view of the right offset embodiment 15 depicted in an in-use state. It can be appreciated that FIG. 4 depicts and describes the right offset embodiment 15 for clarity of illustration and the description of use and structure elements are equivalent related to the left offset embodiment 100. The right offset embodiment 15 and left offset embodiment 100 allow the respective first jaw 22 and second jaw 32 of the device 10 to be used close to a working surface 95, such as a floor or wall, to grip a gripped object 100, for example a wall penetrating pipe or the like. The offset features allow the handles 20, 30 operate at sufficient distance from the working surface 95 to protect a user's hands and fingers from contacting the working surface 95 while using the device.

The right offset features 25, 35 include respective flat angled sections formed divergently from the right offset handles 20, 30 at approximately between twenty) (20° degree and forty-five degree (45°) angle, with a preferred angle being forty-five degrees (45°, so as to offset a side surface of the gripping end of the right offset handles 20, 30 in a right sideward direction approximately one and one-half (1½) to two (2) inches in a parallel manner as indicated by dimension 'A' 55.

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the device 10, it would be utilized as indicated in FIGS. 1 and 4.

The method of utilizing the device 10 may be achieved by performing the following steps: procuring a set of the device 10; applying the jaw covers 70, 72 to the first 22 and second 32 gripping jaws, if desired to protect fine finishes such as chrome from sharp tooth portions of the jaws 22, 32; selecting the right offset embodiment 15 or the left offset embodiment 100 as needed, being visually identified by the respective colored handle grips 27, 127; utilizing the selected embodiment 15, 100 based upon a particular close tool clearance from an adjacent working surface 95; utilizing the right offset embodiment 15 if a working surface 95 be in close proximity to a left side of the device 10 or utilizing the left offset embodiment 100 if the working surface 95 be in close proximity to a right side of the device 10; applying the device 10 to various gripped objects 90 by collapsing the handles 20, 30, 120, 130, and coincidentally the gripping jaws 22, 32, by squeezing the handle grips 27, 127 together using the integral finger reliefs 39 to obtain a firm grip on the gripped object 90; and, benefiting from use of the device 10 to grip objects 90 in close proximity to a working surface 95 while providing safe clearance of one's hand using the device 10.

The procurement and use of a singular device 10 can also be desired being particularly beneficial if performing a repetitious gripping or tightening task which may require an offset clearance on only one (1) side. Furthermore, it can be appreciated that the device 10 is equally beneficial when used in a similar manner as straight-handle adjustable slip-joint pliers for various gripping or tightening applications which do not necessarily require clearance from adjacent obstructions.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. Pliers with offset handles comprising:

a first plier member comprising a first jaw portion, a first joining portion, and a first handle portion, said first handle portion comprising a first extension portion, a first offset portion and a first grip portion, wherein said first offset portion extends from said first extension portion at a non-zero angle and said first grip portion extends from said first offset portion at a non-zero angle; and, a second plier member rotatably connected to said first plier member, said second plier member comprising a second jaw portion, a second joining portion, and a second handle portion, said second handle portion comprising a second extension portion, a second offset portion and a second grip portion, wherein said second offset portion extends from said second extension portion at a non-zero angle and said second grip portion extends from said second offset portion at a non-zero angle;

wherein said first grip portion and said second grip portion share a common plane;

wherein said first extension portion and said second extension portion share a common plane;

wherein said first jaw portion and said second jaw portion share a common plane;

wherein said common plane of said first and second grip portions and said common plane of said first and second extension portions are parallel and offset; and, wherein said common plane of said first and second jaw portions and said common plane of said first and second grip portions are parallel and offset.

2. The pliers of claim 1, wherein said first jaw portion comprises a first toothed surface and said second jaw portion each comprises a second toothed surface, said first toothed surface and said second toothed surface being opposed.

3. The pliers of claim 1, wherein said non-zero angle between said first extension portion and said first offset portion, approximately twenty degrees to approximately forty five degrees.

4. The pliers of claim 1, wherein at least a portion of said first and second grip portions further comprises a protective coating.

5. The pliers of claim 1, further comprising a first jaw cover removably attached to said first jaw portion and a second jaw cover removably attached to said second jaw portion.

6. The pliers of claim 1, wherein said first and second grip portions each further comprises a handle grip sleeve.

7. The pliers of claim 1, wherein said first and second offset portions position said first and second grip portions to the right of said first and second jaw portions.

8. The pliers of claim 1, wherein said first and second offset portions position said first and second grip portions to the left of said first and second jaw portions.

9. The pliers of claim 1, wherein said second jaw portion is adjustably positioned relative to said first jaw portion.

10. The pliers of claim 1, wherein said first and second grip portions each comprises a plurality of finger reliefs for ergonomic engagement by fingers of a user.

11. The pliers of claim 10, wherein said plurality of finger reliefs of said first and second grip portion comprises a protective coating.

12. The pliers of claim 11, wherein said protective coating comprises a handle grip sleeve.

13. The pliers of claim 1, wherein said common plane of said first and second grip portions is positioned to the right of said common plane of said first and second jaw portions.

14. The pliers of claim 1, wherein said common plane of said first and second grip portions is positioned to the left of said common plane of said first and second jaw portions.

15. The pliers of claim 1, wherein said first joining portion is pivotably connected to said second joining portion.

16. The pliers of claim 15, wherein said first joining portion comprises a first aperture and said second joining portion comprises a second aperture, and wherein said first aperture and said second aperture are aligned for passing a bolt fastener therethrough, and a nut fastener is fastened to a leading end of said bolt fastener to pivotably fasten said first plier member relative to said second plier member.

17. The pliers of claim 15, wherein:

said first joining portion comprises:

an elongated first aperture disposed longitudinally therethrough for receiving a bolt fastener, said bolt fastener being slidable within said first aperture; and a plurality of adjustable channels formed on an inner surface about said first aperture, each channel of said plurality of channels having a generally arcuate profile;

said second joining portion comprises:

a second therethrough for receive said bolt fastener; and a curved guide protruding from an inner surface to be concentric relative to said second aperture;

said curved guide selectably engages one channel of said plurality of channels; and, a nut fastener is fastened to a leading end of said bolt fastener to pivotably fasten said first plier member to said second plier member.

18. The pliers of claim 17, wherein said first jaw portion extends perpendicularly from said first joining portion and said first extension portion extends perpendicularly from said first joining portion, said first extension portion and said first jaw portion being parallel, and said first jaw portion, said first joining portion and said first extension portion sharing a common plane.

19. The pliers of claim 18, wherein said second jaw portion and said second extension portion are parallel, and said second jaw portion and said second jaw portion share a common plane.

* * * * *